US009435017B2

(12) United States Patent
Park et al.

(10) Patent No.: US 9,435,017 B2
(45) Date of Patent: Sep. 6, 2016

(54) MANUFACTURING METHOD OF TITANIUM ALLOY WITH HIGH-STRENGTH AND HIGH-FORMABILITY AND ITS TITANIUM ALLOY

(75) Inventors: Chan Hee Park, Changwon-si (KR); Chang Seok Oh, Changwon-si Gyeongnam (KR); Jong Taek Yeom, Gimhae-si (KR); Jae Keun Hong, Changwon-si (KR); Chong Soo Lee, Pohang-si (KR); Yong Taek Hyun, Changwon-si (KR)

(73) Assignee: KOREA INSTITUTE OF MACHINERY & MATERIALS (KR)

( * ) Notice: Subject to any disclaimer, the term of this patent is extended or adjusted under 35 U.S.C. 154(b) by 655 days.

(21) Appl. No.: 13/879,206

(22) PCT Filed: Mar. 19, 2012

(86) PCT No.: PCT/KR2012/001952

§ 371 (c)(1),
(2), (4) Date: Apr. 12, 2013

(87) PCT Pub. No.: WO2013/105699

PCT Pub. Date: Jul. 18, 2013

(65) Prior Publication Data

US 2014/0305554 A1 Oct. 16, 2014

(30) Foreign Application Priority Data

Jan. 11, 2012 (KR) ..... 10-2012-0003287

(51) Int. Cl.
*C22F 1/18* (2006.01)
*C22C 14/00* (2006.01)

(52) U.S. Cl.
CPC ..... *C22F 1/183* (2013.01); *C22C 14/00* (2013.01)

(58) Field of Classification Search
CPC ..... C22F 1/183; C22C 14/00
See application file for complete search history.

(56) References Cited

U.S. PATENT DOCUMENTS

2008/0302451 A1 12/2008 Astanin et al.
2011/0179848 A1 7/2011 Valiev et al.

(Continued)

FOREIGN PATENT DOCUMENTS

JP 2002060873 2/2002
JP 2011068955 4/2011
KR 20110026153 3/2011

OTHER PUBLICATIONS

English Abstract and English Machine Translation of Lee et al. (JP 2011-068955) (Apr. 7, 2011).*
International Search Report for PCT/KR2012/001952, Completed by the Korean Patent Office on Nov. 27, 2012, 3 Pages.
Japanese Office Action for JP 2013-553380, Issued by the Japanese Patent Office, Dated Aug. 26, 2014, 3 Pages.

(Continued)

*Primary Examiner* — Jessee Roe
(74) *Attorney, Agent, or Firm* — Brooks Kushman P.C.

(57) ABSTRACT

A method of manufacturing a titanium alloy with high strength and high formability, the method including preparing a titanium alloy material and equipment for manufacturing the titanium alloy, manufacturing the titanium alloy having a lamellar structure (martensite structure) by cooling the prepared titanium alloy material with water after performing heat treatment at the beta transformation temperature or more, and rolling that makes ultrafine grains by finishing forming of the titanium alloy at a plastic instability temperature or less of an initial lamellar structure by gradually decreasing the forming temperature in accordance with an increase of a strain after starting the forming at the plastic instability temperature or more of an initial lamellar structure, under a condition of a low strain in which the strain is 2.5 or less, after the manufacturing of a titanium alloy having a lamellar structure.

2 Claims, 9 Drawing Sheets

(56) References Cited

U.S. PATENT DOCUMENTS

2012/0160378 A1 6/2012 Park et al.
2012/0168042 A1 7/2012 Lee et al.

OTHER PUBLICATIONS

Park et al. Materials Science and Engineering A 2008, vol. 496, pp. 150-158, "Enhanced superplasticity utilizing dynamic globularization of Ti-6A1-4V alloy."

* cited by examiner

MANUFACTURING METHOD OF TITANIUM ALLOY WITH HIGH-STRENGTH AND HIGH-FORMABILITY AND ITS TITANIUM ALLOY

CROSS-REFERENCE TO RELATED APPLICATION

This application is the U.S. national phase of PCT Appln. No. PCT/KR2012/001952 filed Mar. 19, 2012 which claims priority to Korean Application No. KR 10-2012-0003287 filed Jan. 11, 2012, the disclosures of which are incorporated in their entirety by reference herein.

BACKGROUND OF THE INVENTION

1. Field of the Invention

The present invention relates to a method of manufacturing a titanium alloy with high strength and high formability, and more particularly a titanium alloy provided with ultrafine grains with high strength/high formability through rolling that gradually changes a forming temperature in accordance with the strain under relatively low strain (strain of 2.5 or less) without using severe plastic deformation known in the art, and a method of manufacturing the titanium alloy.

In detail, the present invention relates to a titanium alloy having ultrafine grains with high strength/high formability by making the final temperature, at which forming is finished, a plastic instability temperature or less of an initial lamellar structure (martensite) while gradually decreasing a forming temperature into an optimized condition, by using a principle that formability increases with an increase in a fine spheroidized structure during deformation, after starting deformation at the beta transformation temperature or less and the plastic instability temperature or more of an initial lamellar structure (martensite), without simply decreasing the forming temperature during forming, and a method of manufacturing the titanium alloy.

2. Description of Related Art

A titanium alloy is typical lightweight metal and has high specific strength and excellent corrosion resistance, so that it can be used for various fields, such as a material for the aerospace industry, a material for the chemical industry, a material for bio-implant, and a material of sports products. Since the titanium alloy has a superplastic property, it is possible to reduce the weight of a product and the machining cost by performing superplastic forming. Therefore, it is possible to create a large added value by applying the titanium alloy to industries.

It has been known that superplastic forming of the titanium alloy is possible only by processing the titanium alloy generally at a high processing temperature of 850° C. or more with strain rate of 0.001/sec or less. However, since the superplastic property is largely influenced by a fine structure, superplastic forming can be performed on a titanium alloy composed of fine grains at a lower processing temperature or higher strain rate than the related art.

Accordingly, with the development of nanotechnology, a research about a method of manufacturing a titanium alloy with fine grains has been actively conducted.

Meanwhile, there are methods, such as powder metallurgy, mechanical alloying, rapid solidifying, recrystallizing, forging, rolling, and drawing, as the methods of manufacturing a material with fine grains.

However, it is difficult to manufacture a material having a sufficient size, using the methods, and a large amount of pores may be formed inside. Further, as the size is limited or the strain increases, in of recrystallized grains, the cross-sectional area decreases, so that it is difficult to give a large amount of deformation and there is a specific limit in making the grains fine. Therefore, it is difficult to practically apply making grains fine with the method.

Recently, severe plastic deformation that makes grains fine without generating pores inside by performing severe plastic deformation without specific heat treatment has been proposed. There are HPT (high pressure torsion) and ECAP (equal channel angular pressing), as the severe plastic deformation.

The HPT machining is a method of generating shear deformation under a high pressure and has a problem in that machining can be performed with a high speed at a room temperature, while the size of the material is limited and the thickness and the fine structure of the material are not uniform.

The ECAP machining is a method of generating shear deformation of a material by putting in the material to an L-shaped channel and is economical because it is possible to perform forming with existing equipment and increase the scale. Further, since the cross-sectional area of the material does not decrease even if the amount of machining increases, it is possible to provide the material with a large amount of deformation.

However, the sizes of specimens produced by the current severe plastic deformation are so small that it is very restrictive to industrially produce and use a titanium alloy with ultrafine grains.

Further, since the severe plastic deformation of the related art requires large strain (4 to 8), there is a problem in that it is difficult to make grains ultrafine by using rolling or extruding equipment of common coMPanies.

SUMMARY OF THE INVENTION

An embodiment of the present invention is directed to providing a method of manufacturing a titanium alloy (Ti-6Al-4V,Ti-6Al-2Sn-4Zr-2Mo-0.1Si,Ti-6Al-4Fe-0.25Si) with high strength and high formability, which includes: rolling that changes a titanium alloy to have ultrafine grains by rolling the titanium alloy under a low-strain condition, where the strain is 2.5 or less under a predetermined temperature change condition, where the final temperature for finishing forming is lower than the plastic instability temperature of an initial lamellar structure (martensite), while gradually decreasing a forming temperature into an optimized condition, by using a principle that formability increases with an increase in a fine spheroidized structure during deformation, after starting deformation of the titanium alloy at the beta transformation temperature or less and the plastic instability temperature or more of an initial lamellar structure (martensite), without simply decreasing the forming temperature during forming, at a predetermined deformation speed after manufacturing the titanium alloy having a lamellar structure.

Another embodiment of the present invention is directed to providing titanium alloys (Ti-6Al-4V, Ti-6Al-2Sn-4Zr-2Mo-0.1Si, and Ti-6Al-4Fe-0.25Si) manufactured by the manufacturing method to have ultrafine grains of which the size is 1 μm or less.

To achieve the object of the present invention, the present invention provides a method of manufacturing a titanium alloy with high strength and high formability, which includes: preparing a material and equipment for manufacturing a titanium alloy; manufacturing a titanium alloy having a lamellar structure (martensite structure) by cooling the prepared material with water after performing heat treatment at the beta transformation temperature or more; and rolling that makes ultrafine grains by finishing forming of the titanium alloy at a plastic instability temperature by gradually decreasing the forming temperature in accordance with an increase of a strain after starting the forming at the plastic instability temperature of more, under a condition of a low strain in which the strain is 2.5 or less, after the manufacturing of a titanium alloy having a lamellar structure.

Further, in the rolling, the initial forming start temperature for starting the forming is the plastic instability temperature or more of an initial lamellar structure, the final forming temperature for finishing the forming is the plastic instability temperature or less of an initial lamellar structure, and the process is finished while maintaining the plastic instability temperature or less of the initial lamellar structure when the strain reaches 2.5 while decreasing the temperature along a predetermined drop curve in accordance with an increase in the strain after starting the forming at a forming temperature of the plastic instability temperature or more at the initial stage.

Further, the present invention provides a method of manufacturing a titanium alloy (Ti-6Al-4V) with high strength and high formability, which includes: preparing a material and equipment for manufacturing a titanium alloy (Ti-6Al-4V); manufacturing a titanium alloy having a lamellar structure (martensite structure) by cooling the prepared material with water after performing heat treatment for one hour or more under the condition of a temperature of 1040° C. at the beta transformation temperature (995° C.) or more; and rolling that makes ultrafine grains by finishing forming of the titanium alloy at a plastic instability temperature or less by gradually decreasing the forming temperature in accordance with an increase of strain after starting the forming at the plastic instability temperature of more, under a condition of a low strain in which the strain is 1.4 or less, after the manufacturing of a titanium alloy having a lamellar structure.

Further, in the rolling, the forming is started at 800° C., which is an initial forming start temperature, above a plastic instability temperature of an initial lamellar structure and is finished at 600° C., which is a final forming temperature, under the plastic instability temperature of the initial lamellar structure.

Further, in the rolling, the forming temperature initially starts from 800° C., is decreased along a predetermined drop curve as the strain increases, and the process is finished while the temperature at 600° C. when strain reaches 1.4.

Further, the present invention provides a titanium alloy (Ti-6Al-4V) manufactured by the method to have ultrafine grains of which the size is 1 μm or less.

Further, the present invention provides a method of manufacturing a titanium alloy (Ti-6Al-2Sn-4Zr-2Mo-0.1Si) with high strength and high formability, which includes: preparing a material and equipment for manufacturing a titanium alloy (Ti-6Al-2Sn-4Zr-2Mo-0.1Si); manufacturing a titanium alloy having a lamellar structure (martensite structure) by cooling the prepared material with water after performing heat treatment for one hour or more under the condition of a temperature of 1040° C. at the beta transformation temperature (995° C.) or more; and rolling that makes ultrafine grains by finishing forming of the titanium alloy at a plastic instability temperature or less by gradually decreasing the forming temperature in accordance with an increase of strain after starting the forming at the plastic instability temperature of more, under a condition of a low strain in which the strain is 1.4 or less, after the manufacturing of a titanium alloy having a lamellar structure.

Further, in the method of manufacturing a titanium alloy (Ti-6Al-2Sn-4Zr-2Mo-0.1Si) with high strength and high formability, in the rolling, the forming is started at 850° C., which is an initial forming start temperature, above a plastic instability temperature of an initial lamellar structure and is finished at 650° C., which is a final forming temperature, under the plastic instability temperature of the initial lamellar structure.

Further, the present invention provides a titanium alloy (Ti-6Al-2Sn-4Zr-2Mo-0.1Si) manufactured by the method to have ultrafine grains of which the size is 1 μm or less.

Further, the present invention provides a method of manufacturing a titanium alloy (Ti-6Al-4Fe-0.25Si) with high strength and high formability, which includes: preparing a material and equipment for manufacturing a titanium alloy (Ti-6Al-4Fe-0.25Si); manufacturing a titanium alloy having a lamellar structure (martensite structure) by cooling the prepared material with water after performing heat treatment for one hour or more under the condition of a temperature of 1040° C. at the beta transformation temperature (995° C.) or more; and rolling that makes ultrafine grains by finishing forming of the titanium alloy at a plastic instability temperature or less by gradually decreasing the forming temperature in accordance with an increase of strain after starting the forming at the plastic instability temperature of more, under a condition of a low strain in which the strain is 1.4 or less, after the manufacturing of a titanium alloy having a lamellar structure.

Further, in the method of manufacturing a titanium alloy (Ti-6Al-4Fe-0.25Si) with high strength and high formability, in the rolling, the forming is started at 800° C., which is an initial forming start temperature, above a plastic instability temperature of an initial lamellar structure and is finished at 600° C., which is a final forming temperature, under the plastic instability temperature of the initial lamellar structure.

Another embodiment of the present invention is directed to providing a titanium alloy (Ti-6Al-4Fe-0.25Si) manufactured by the method to have ultrafine grains of which the size is 1 μm or less.

DESCRIPTION OF SPECIFIC EMBODIMENTS

Hereinafter, specific embodiments of the present invention are described in detail with reference to the drawings. However, the scope of the present invention is not limited the embodiments but other retrogressive inventions or other embodiments included in the scope of the present invention can be easily proposed by adding, modifying, removing, etc. of another components.

Figure 1:
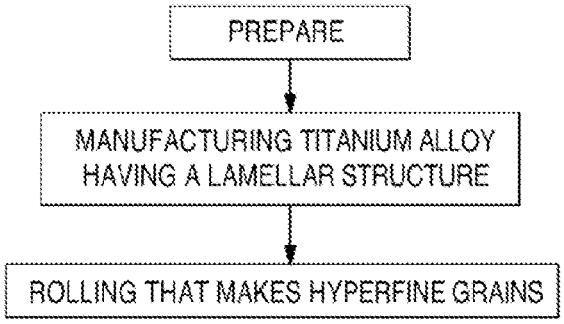
FIG. 1 is a flowchart illustrating a method of manufacturing a titanium alloy (Ti-6Al-4V) with high strength and high formability according to the present invention.

FIG. 1 is a flowchart illustrating a method of manufacturing a titanium alloy (Ti-6Al-4V) with high strength and high formability according to the present invention.

Figure 2A:
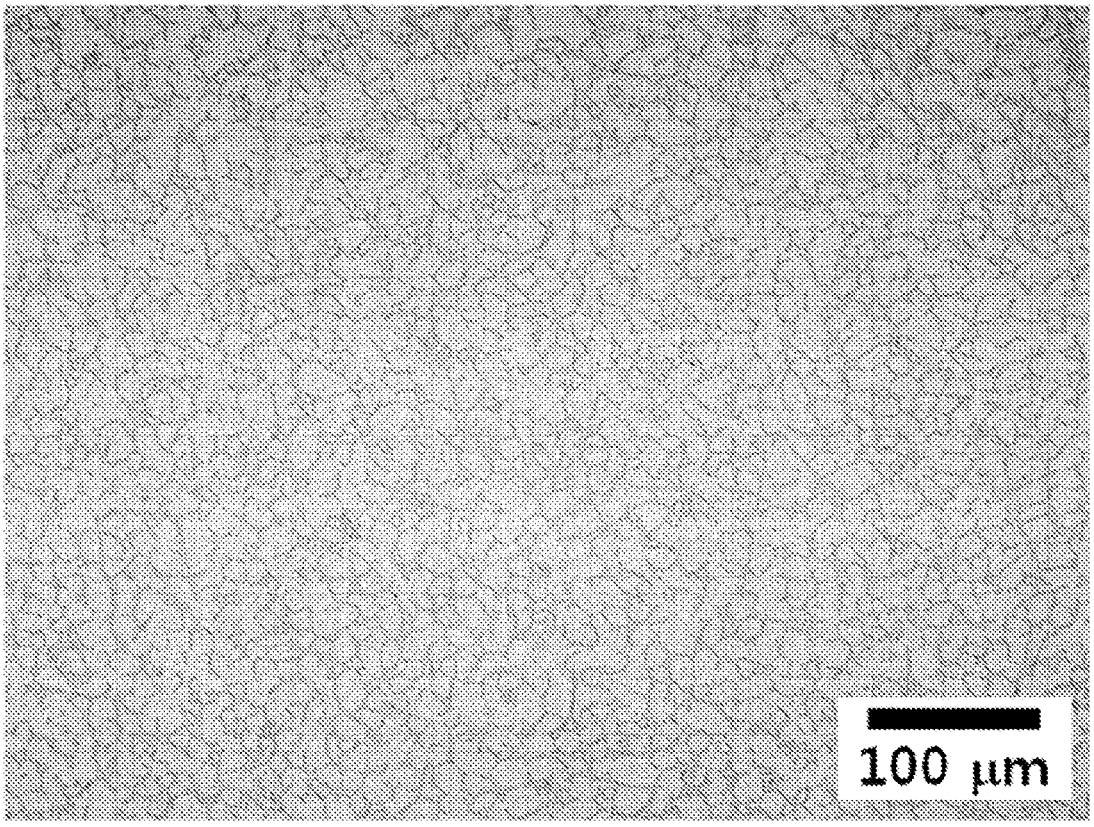
FIG. 2A is a picture showing a microstructure of a titanium alloy (Ti-6Al-4V) having an early equiaxed structure that is used for the method of manufacturing a titanium alloy (Ti-6Al-4V) with high strength and high formability according to the present invention and FIG. 2B is a picture of a microstructure of a titanium alloy (Ti-6Al-4V) having a lamellar (martensite) structure.
Figure 2B:
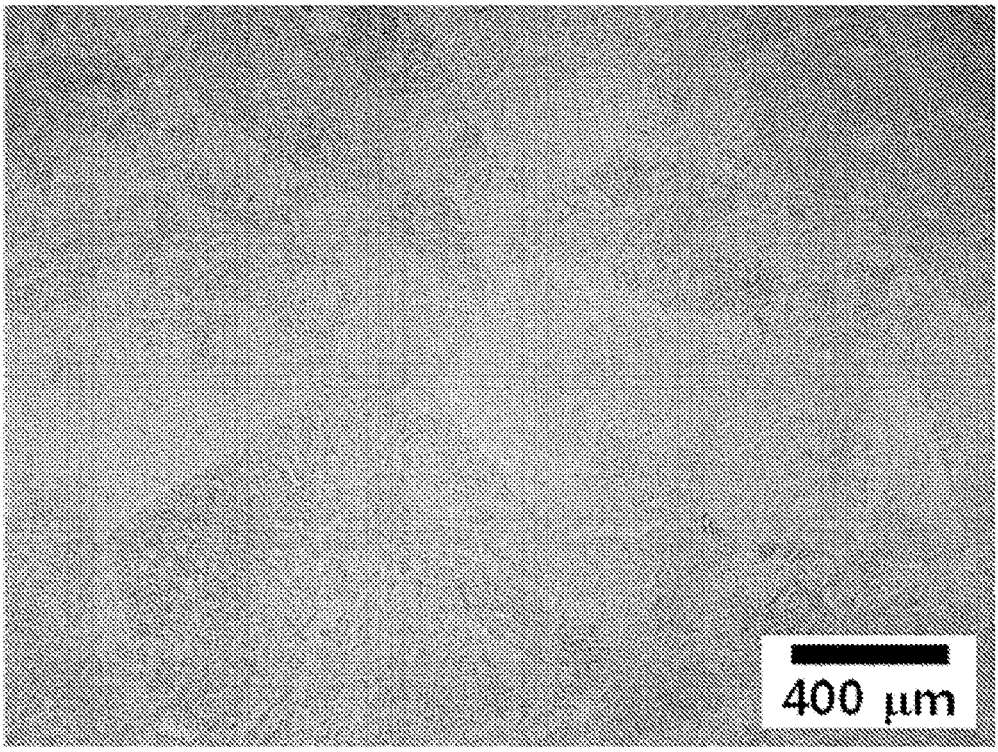

FIG. 2A is a picture showing a microstructure of a titanium alloy (Ti-6Al-4V) having an early equiaxed structure that is used for the method of manufacturing a titanium alloy (Ti-6Al-4V) with high strength and high formability according to the present invention and FIG. 2B is a picture of a microstructure of a titanium alloy (Ti-6Al-4V) having a lamellar (martensite) structure.

Referring to FIG. 1, a method of manufacturing a titanium alloy with high strength and high formability according to an embodiment of the present invention includes: preparing a material and equipment for manufacturing a titanium alloy; manufacturing a titanium alloy having a lamellar structure (martensite structure) by cooling the prepared material with water after performing heat treatment at the beta transformation temperature or more; and rolling that makes ultrafine grains by finishing forming of the titanium alloy at a plastic instability temperature by gradually decreasing the forming temperature in accordance with an increase of a strain after starting the forming at the plastic instability temperature of more, under a condition of a low strain in which the strain is 2.5 or less, after the manufacturing of a titanium alloy having a lamellar structure.

Further, in the rolling, the initial forming start temperature for starting the forming is the plastic instability temperature or more of an initial lamellar structure, the final forming temperature for finishing the forming is the plastic instability temperature or less of an initial lamellar structure, and the process is finished while maintaining the plastic instability temperature or less of the initial lamellar structure when the strain reaches 2.5 while decreasing the temperature along a predetermined drop curve in accordance with an increase in the strain after starting the forming at a forming temperature of the plastic instability temperature or more at the initial stage.

In detail, the method of manufacturing a titanium alloy (Ti-6Al-4V) according to an embodiment includes: preparing a material and equipment for manufacturing a titanium alloy (Ti-6Al-4V); manufacturing a titanium alloy having a lamellar structure (martensite structure) by cooling the prepared material with water after performing heat treatment for one hour or more at a temperature condition of 1040° C. above the beta transformation temperature (995° C.); and rolling that makes ultrafine grains by rolling the titanium alloy under the condition of a low strain, in which the strain is 1.4 or less under a predetermined temperature change condition, at a predetermined deformation speed after the manufacturing of a titanium alloy having a lamellar structure.

The processes of the manufacturing method are described in detail.

First, a titanium alloy material for forming is prepared in the preparation process of a titanium alloy. The titanium alloy may be a titanium alloy with aluminum (Al) and vanadium (V) added to increase strength and ductility.

The titanium alloy of the embodiment is a so-called Ti-6Al-4V alloy containing aluminum of about 6 wt % and vanadium of about 4 wt %. The Ti-6Al-4V alloy can be used in various industries because it is light and has high strength, and super plastic property is also excellent. However, the present invention is not limited thereto and various titanium alloys other than the Ti-6Al-4V alloy may be used, which is also included in the scope of the present invention.

The titanium alloy may be formed in a lamellar (martensite) structure having a prior beta grain boundary of about 400 μm and an acicular thickness of about 0.3 μm by cooling the material (with water) after performing heat treatment for one hour at 1040° C. above the beta transformation temperature (about 995° C.). FIG. 2 shows a picture of a titanium alloy having the martensite structure. Alternatively, the titanium alloy may have a fine basket weave.

Although the basket weave has machinability that is not excellent more than an equiaxed structure, beta phases are more finely distributed than the equiaxed structure. For a martensite structure of a fine basket weave in which alpha phases and beta phases are continuously distributed with gaps of 1 μm, for example, the beta phases are segmented by a dynamic spheroidizing mechanism in the rolling of a titanium alloy of the embodiment, so that the alpha phases and the beta phases can be more finely and uniformly distributed after the rolling, as coMPared with an equiaxed structure is used at the initial stage.

Further, since the sizes of the alpha phases and the beta phases distributed in the initial martensite structure or fine basket weave are very small, they can be more finely controlled after the rolling.

'Thereafter, in the rolling of a titanium alloy, the titanium alloy starts to be rolled at a temperature of 800° C. at a strain rate of 0.1/sec and the rolling keeps performed while gradually reducing the temperature to 600° C. after starting the rolling.

Dynamic spheroidization is sufficiently generated by rolling the titanium alloy in this condition, and recrystallizing and annealing that were performed for dynamic spheroidization after the rolling in the related art may not be performed in the embodiment.

Describing the mechanism for dynamic spheroidization, torsion is generated in the early alpha phases having a lamellar structure and shear stress gradually concentrates into the alpha phases, so that equiaxed alpha phases having a grain boundary are formed at the portions where the shear stress is exerted.

Many transpositions concentrate in the direction in which the shear stress is exerted, so that many transpositions are formed on the grain boundary. Therefore, when the dynamic spheroidization is achieved, a fine structure having a quasi-stable phase where many transpositions remain around the grain boundary is formed, so that specific heat treatment is not necessary.

As described above, in the present invention, the deformation temperature in the rolling of a titanium alloy is determined in consideration of the size of the grains after the dynamic spheroidization and rolling. Further, the more the strain, the more the degree of the dynamic spheroidization increases. As described above, torsion is generated in the alpha phases in the first step for the dynamic spheroidization, which is considered because torsion is generated in more alpha phases, as the strain increases.

Therefore, the strain may be 0.9 or more such that the dynamic spheroidization can be uniformly generated. Considering that it is practically difficult to give a large strain over 2.0, the strain may be 0.9 to 2.0.

However, since it is difficult to achieve a large strain (strain of 2.5 or more) of 2.5 or more by using rolling equipment or extruding equipment of current common companies or industries, the sizes of specimens that can be produced by manufacturing methods that require a large strain of 2.5 or more, as described above, are so small that it is necessarily restrictive to industrially produce and use a titanium alloy having ultrafine grains.

In the embodiment of the present invention, the strain is set to 1.4 or less to allow grains to be made ultrafine with a low strain (1.5 or less), so that it is possible to produce a titanium alloy having ultrafine grains by using rolling/extruding/forging equipment widely used in industry.

Meanwhile, the strain rate in the rolling of a titanium alloy may be 0.1/sec in the embodiment.

This is because when the strain rate is below 0.0007/sec, the strain rate is too small, so that the process time of the rolling of a titanium alloy may be too long, or when the strain rate is above 1.3/sec, the dynamic spheroidization may not be uniformly generated by the high strain rate.

Figure 3A:
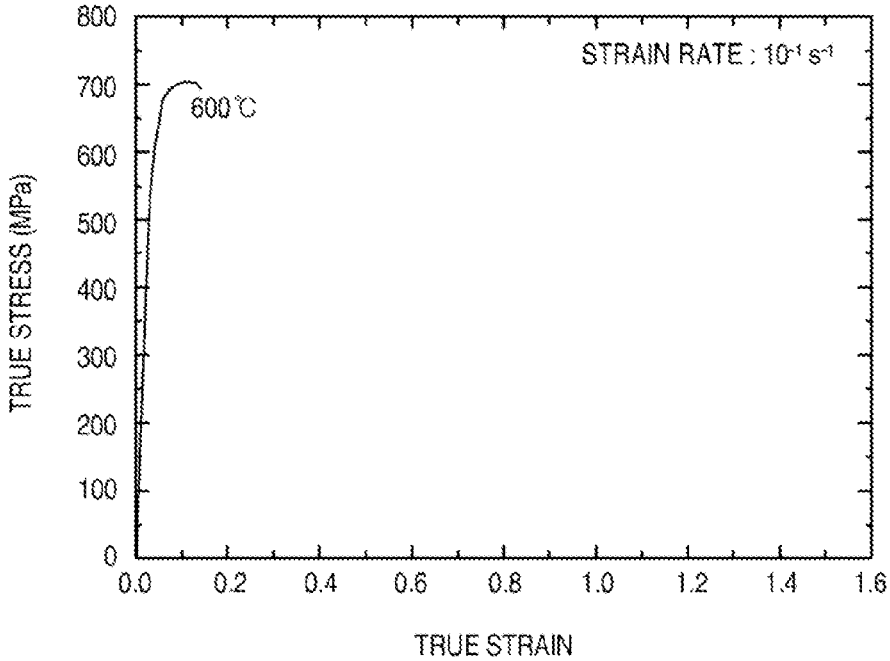
FIGS. 3A to 3C are graphs showing true stress (MPa) according to a deformation temperature and a strain in rolling.
Figure 3B:
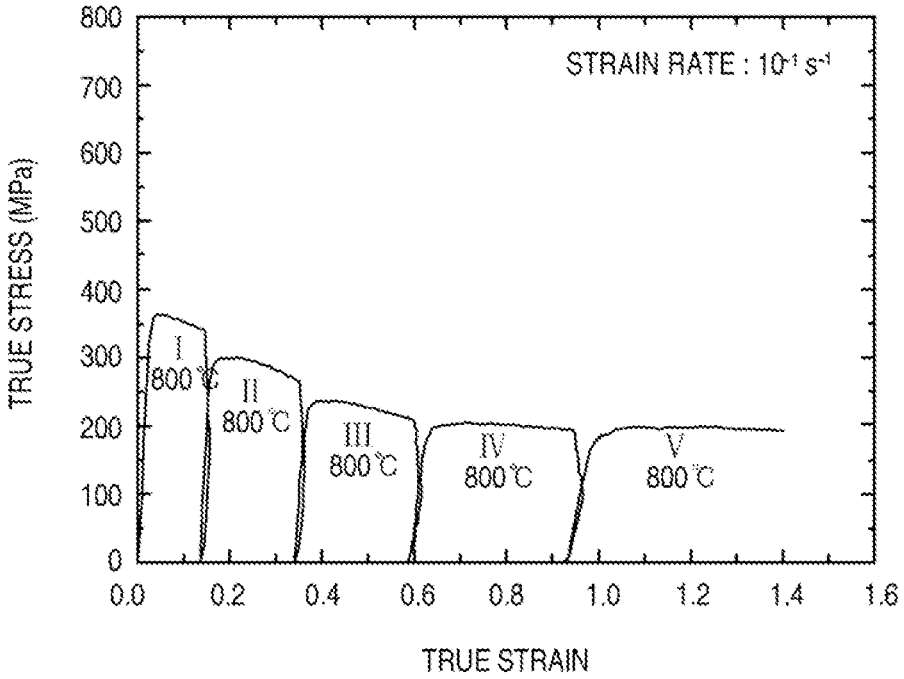
Figure 3C:
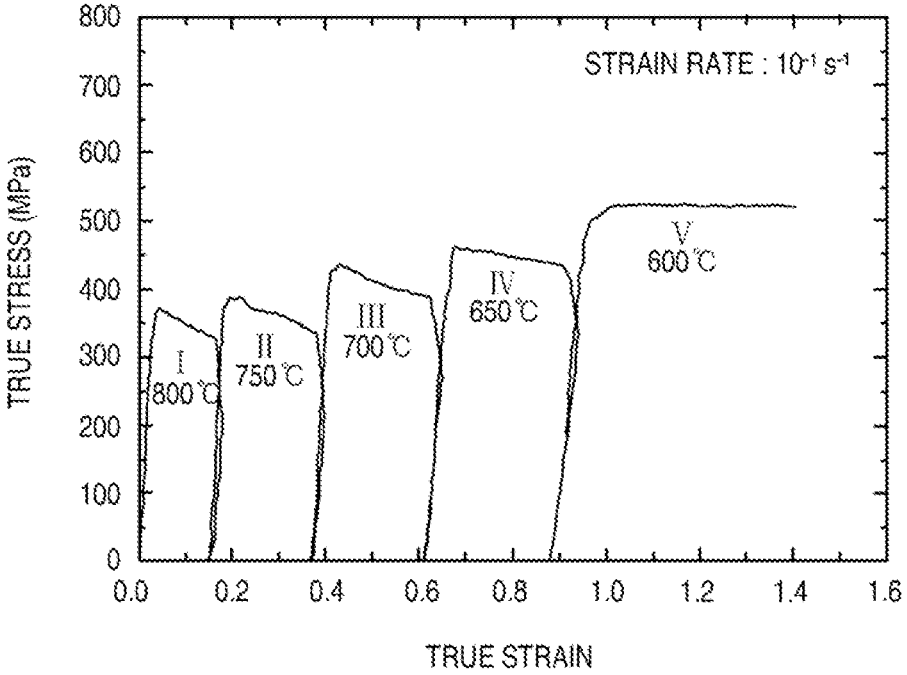

FIGS. 3A to 3C are graphs showing true stress (MPa) according to a deformation temperature and a strain in rolling.

First, the relationship between the strain, the deformation temperature, the deformation speed, and the true stress (MPa) are described with reference to FIGS. 3A to 3C.

First, FIG. 3A is a graph of a comparative example 1 showing the result of a test compressing the lamellar structure of FIG. 2B to a strain of 1.4 under the condition of a strain rate of 0.1/sec at a temperature of 600° C.

It can be seen from test result of the comparative example 1 that breaking occurred at a strain of about 0.13, so that forming was not performed well.

FIG. 3B is a graph showing the result of a test of compressing the lamellar structure of FIG. 2B to a strain of 1.4 under the condition of a strain rate of 0.1/sec at a temperature of 800° C. according to a comparative example 2. It can be seen from the test result that breaking did not finally occur and forming was performed well.

FIG. 3C is a graph showing the result of a test that compressing the lamellar structure of FIG. 2B to a strain of 1.4 while gradually decreasing the forming temperature from 800° C. to 600° C., under the condition of a strain rate of 0.1/sec, as an embodiment of the present invention.

It can be also seen from the test result that breaking did not finally occur and forming was performed well.

An embodiment of the present invention shown in FIG. 3C and a comparative example 2 shown in FIG. 3B are described more.

In general, dynamic spheroidization occurs in a titanium alloy having an initial lamellar (martensite) structure at a temperature of 775° C. to 975° C. When the deformation temperature is too low, less than 775° C., dynamic spheroidization does not occur and fine cracks are generated or shear bands are formed between the alpha phases.

Further, when the deformation temperature is over 975° C., that is, it is the beta transformation temperature (about 977° C.) or more, beta recrystallization having a prior beta grain boundary occurs, so that dynamic spheroidization is difficult. Further, when the deformation temperature is high, the grains may be increased in size by grain growth.

Further, the dynamic spheroidization fraction is generally in proportion to the strain and in inverse proportion to the deformation speed and deformation temperature. Therefore, the deformation temperature is generally set at 875° C. or less.

For this reason, in general, since unstable deformation is generated at 750° C. or less, forming is performed between 800° C. and 950° C., and in the embodiment of the present invention, it was scientifically founded that formability increases because a lamellar structure is changed into an equiaxed structure with an increase in strain.

Therefore, it was possible to gradually decreasing the forming temperature to fit the condition where the strain increases. When it becomes possible to decrease the forming temperature, it is possible to reduce the amount of energy consumed in the rolling, so that it is possible to not only achieve an economic effect, but more easily perform the rolling for forming.

This is not conception that simply and freely decreases the forming temperature from 800° C. to 600° C., but conception that gradually changes the condition of the temperature in accordance with the condition of the strain.

That is, the main conception of the present invention relates to a titanium alloy having ultrafine grains with high strength/high formability by making the final temperature, at which forming is finished, a plastic instability temperature or less of a lamellar structure (martensite) while gradually decreasing a forming temperature into an optimized condition, by using a principle that formability increases with an increase in a fine spheroidized structure during machining, after starting machining at the plastic instability temperature or more of an initial lamellar structure (martensite), not simply decreasing the forming temperature during forming, and a method of manufacturing the titanium alloy.

The plastic instability section is a section where cracks, shear bands, pores, or breaking is formed during deformation, which is generally about 750° C. to 650° C. when a titanium alloy has an initial lamellar structure (martensite).

As an embodiment of the conception described above, in the rolling according to an embodiment of the present invention, the temperature changes from 800° C. to 750° C. under the condition that the strain is 0.1 to 0.2, the temperature changes from 750° C. to 700° C. under the condition that the strain is 0.3 to 0.4, the temperature changes from 700° C. to 650° C. under the condition that the strain is 0.6 to 0.7, and a temperature of 600° C. is maintained under the condition that the strain is 0.9 to 1.4.

Figure 4A:
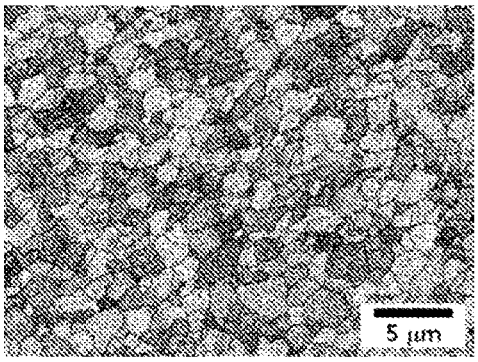
FIG. 4A is microstructure of titanium manufactured by the comparative example shown in FIG. 3B
Figure 4B:
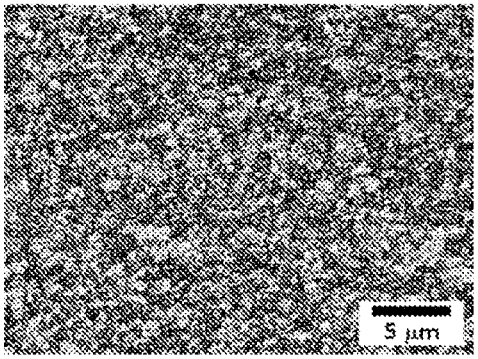
FIG. 4B is microstructure of a titanium alloy (Ti-6Al-4V) formed by the present invention as in FIG. 3C.

FIGS. 4A and 4B are microstructures of titanium manufactured by the comparative example 2 shown in FIG. 3B and titanium alloy (Ti-6Al-4V) formed by the method of manufacturing a titanium alloy (Ti-6Al-4V) according to an embodiment of the present invention.

FIG. 4A is an inverse pole figure of comparative example 2, in which the size of grains of a titanium alloy formed under the forming conditions of comparative example 2 is about 2 μm.

FIG. 4B is an inverse pole figure of grains of the titanium alloy (Ti-6Al-4V) formed through the rolling according to an embodiment of the present invention, in which the size of the grains is about 0.5 μm. Forming of the titanium alloy (Ti-6Al-4V) having ultrafine grains with the sizes of grains described above was generally possible only under a large strain of 4 to 8 in the related art.

That is, it is possible to manufacture a titanium alloy (Ti-6Al-4V) having ultrafine grains, as shown in FIG. 4B, under the condition of a strain of about 1.4, using the method of manufacturing a titanium alloy (Ti-6Al-4V) according to an embodiment of the present invention.

FIG. 5 shows a graph illustrating another embodiment of the present invention.

FIG. 5 is a graph showing true stress (MPa) according to a deformation temperature and a strain in compressing of Ti-6Al-2Sn-4Zr-2Mo-0.1Si that is another titanium alloy.

Figure 5A:
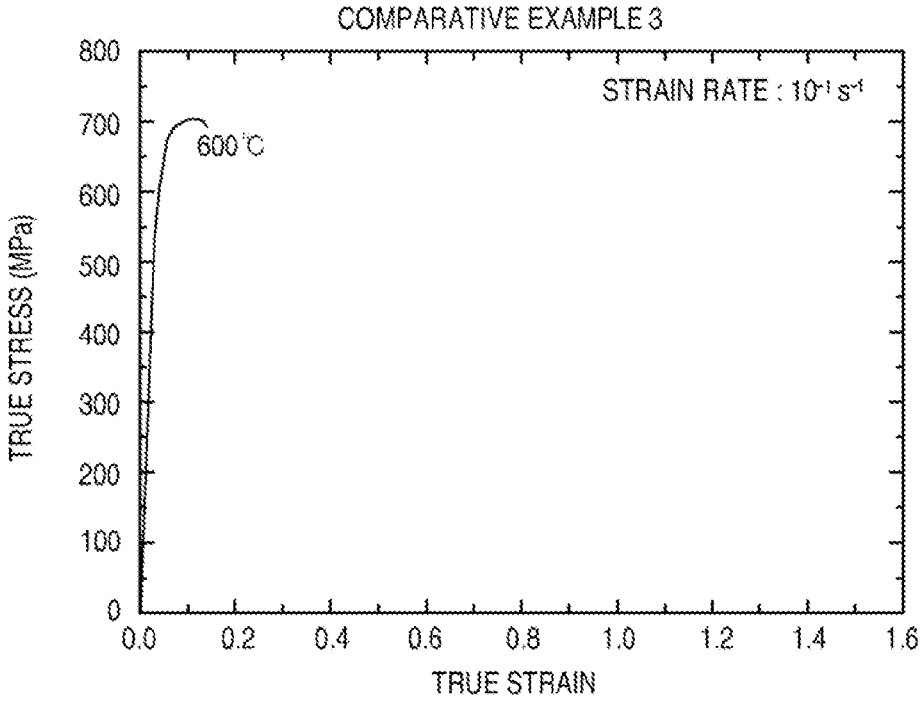
FIG. 5 is a graph showing true stress (MPa) according to a deformation temperature and a strain in compressing of Ti-6Al-2Sn-4Zr-2Mo-0.1Si that is another titanium alloy.

The comparative example 3 shown in FIG. 5A shows the result of a test that makes Ti-6Al-2Sn-4Zr-2Mo-0.1Si have a lamellar structure first, and then performs compression to a strain of 1.4 with a strain rate of 0.1/sec at a forming temperature of 650° C.

It can be seen from the result of the compression test that breaking occurred upon reaching a strain of about 0.2, so that forming was not achieved.

Figure 5B:
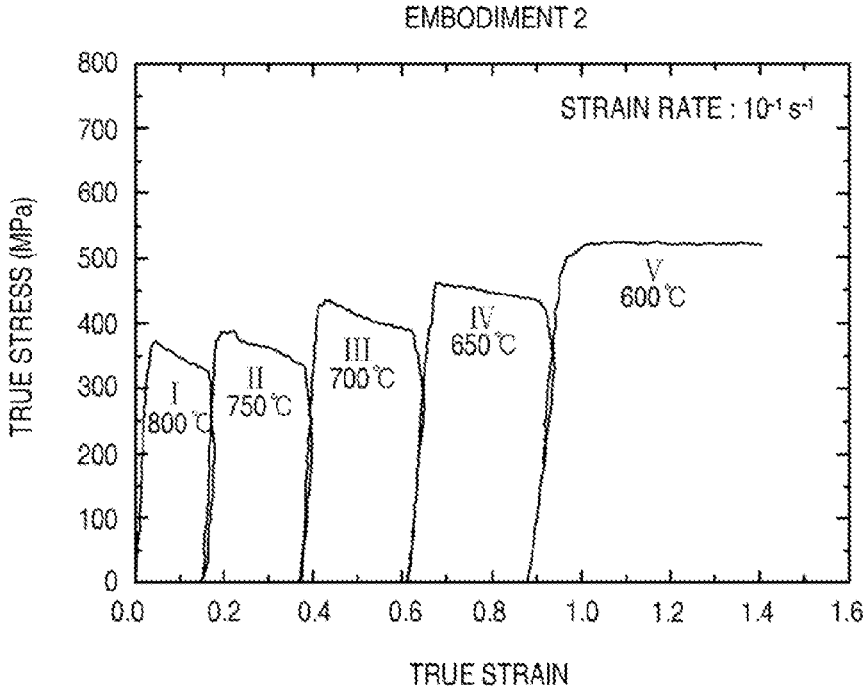

On the contrary, FIG. 5B is a graph showing forming conditions in the rolling of the method of manufacturing a titanium alloy (Ti-6Al-2Sn-2Mo-0.1Si) according to another embodiment of the present invention.

For the Ti-6Al-2Sn-4Zr-2Mo-0.1Si alloy, test was performed by making a lamellar (martensite) structure first and then decreasing the forming temperature step by step from 850° C. to 650° C. during compression to a strain of 1.4 at a strain rate of 0.1/sec.

As a result of the test of FIG. 5B, forming was achieved well without breaking up to the final step.

Figure 6A:
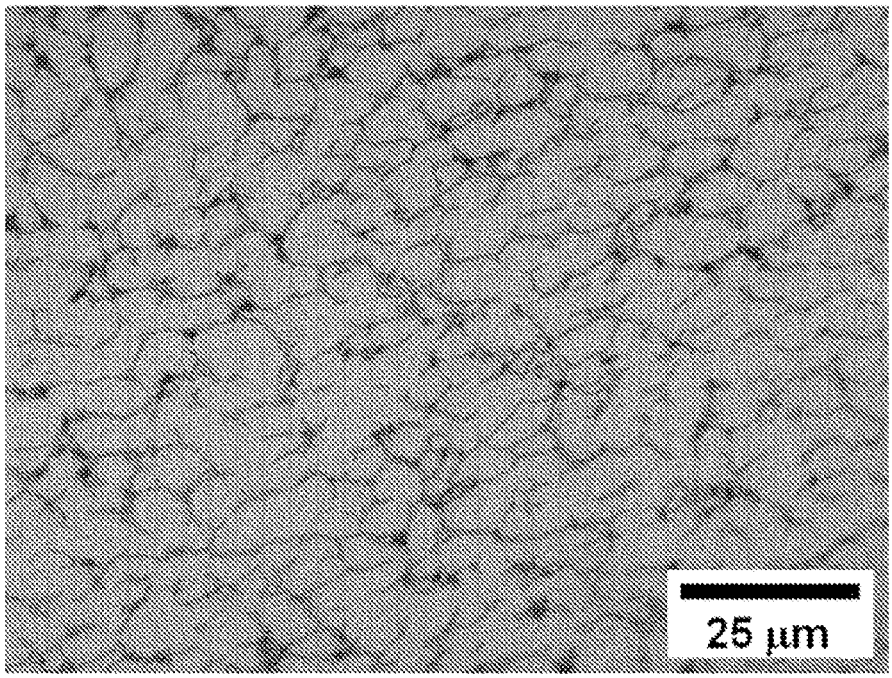
FIG. 6A is a picture showing an early structure of Ti-6Al-2Sn-4Zr-2Mo-0.1Si
Figure 6B:
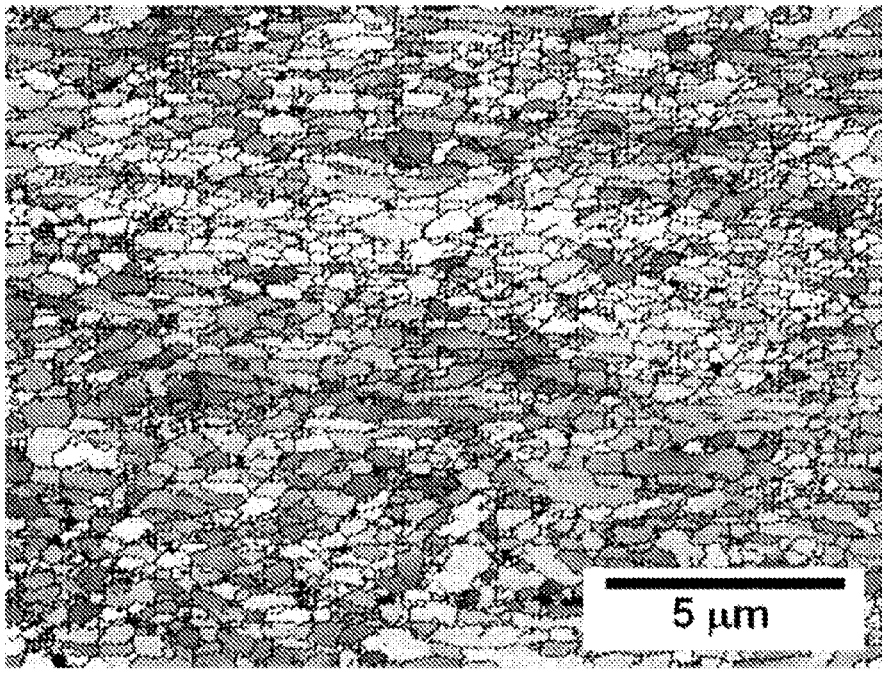
FIG. 6B is a picture of a microstructure of a titanium alloy (Ti-6Al-2Sn-4Zr-2Mo-0.1Si) manufactured by another embodiment of the present invention.

FIG. 6A is a picture showing an early structure of Ti-6Al-2Sn-4Zr-2Mo-0.1Si and FIG. 6B is a picture of a fine structure of a titanium alloy (Ti-6Al-2Sn-4Zr-2Mo-0.1Si) manufactured by another embodiment of the present invention.

FIG. 6A is a picture showing the state of grains of an early fine structure of a Ti-6Al-2Sn-4Zr-2Mo-0.1Si alloy, from which it can be seen that the grains have a size of about 13 μm.

On the contrary, FIG. 6B shows a fine picture of grains of a titanium alloy (Ti-6Al-2Sn-4Zr-2Mo-0.1Si) that has undergone the rolling of the method of manufacturing a titanium alloy (Ti-6Al-2Sn-4Zr-2Mo-0.1Si) according to another embodiment of the present invention.

In detail, it can be seen that the grains of the titanium alloy (Ti-6Al-2Sn-4Zr-2Mo-0.1Si) according to another embodiment of the present invention are ultrafine grains having a size of about 0.4 μm in FIG. 6B.

Forming of the ultrafine grains having a size of about 0.4 μm was generally possible only under the condition of a large strain of 4 to 8.

It can be seen that it is possible to manufacture a titanium alloy (Ti-6Al-2Sn-4Zr-2Mo-0.1Si) having ultrafine grains, as shown in FIG. 6B, under the condition of a strain of about 1.4, using the method of manufacturing a titanium alloy (Ti-6Al-2Sn-4Zr-2Mo-0.1Si) according to another embodiment of the present invention.

FIG. 7 shows a graph illustrating another embodiment of the present invention.

FIG. 7 is a graph showing true stress (MPa) according to a deformation temperature and a strain in compressing of Ti-6Al-4Fe-0.25Si that is another titanium alloy.

Figure 7A:
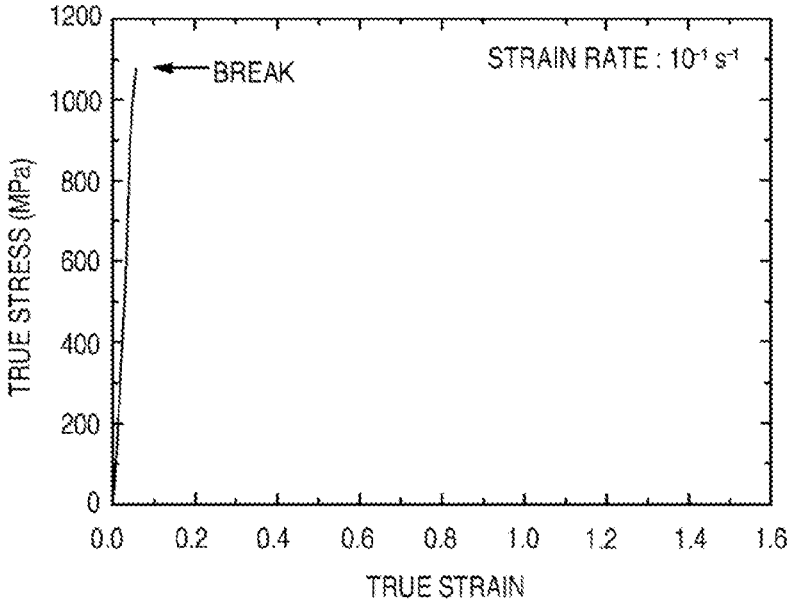
FIG. 7 is a graph showing true stress (MPa) according to a deformation temperature and a strain in compressing of Ti-6Al-4Fe-0.25Si that is another titanium alloy.

The comparative example shown in FIG. 7A shows the result of a test that makes Ti-6Al-4Fe-0.25Si have a lamellar structure first, and then performs compression to a strain of 1.4 with a strain rate of 0.1/sec at a forming temperature of 600° C.

It can be seen from the result of the compression test that breaking occurred upon reaching a strain of about 0.05, so that forming was not achieved.

Figure 7B:
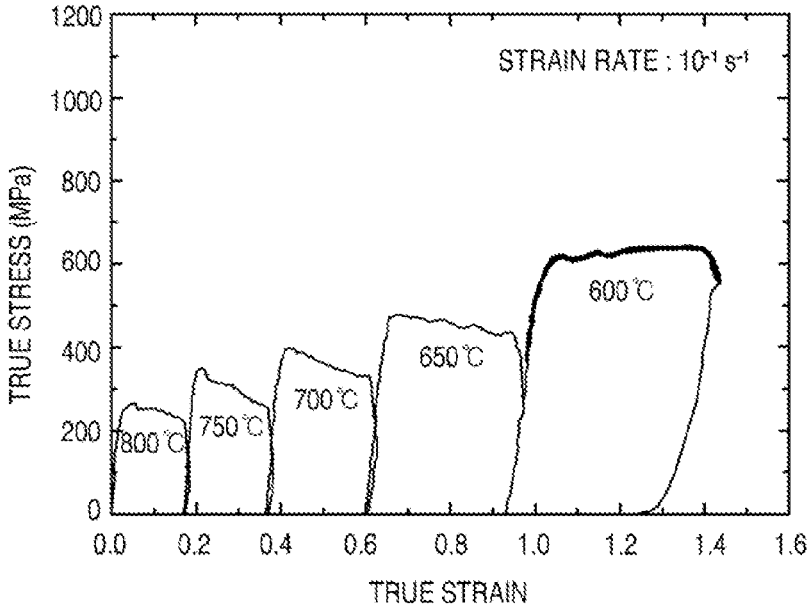

On the contrary, FIG. 7B is a graph showing forming conditions in the rolling of the method of manufacturing a titanium alloy (Ti-6Al-4Fe-0.25Si) according to another embodiment of the present invention.

For the Ti-6Al-4Fe-0.25Si alloy, test was performed by making a lamellar (martensite) structure first and then decreasing the forming temperature step by step from 800° C. to 600° C. during compression to a strain of 1.4 at a strain rate of 0.1/sec.

As a result of the test of FIG. 7B, forming was achieved well without breaking up to the final step.

Figure 8A:
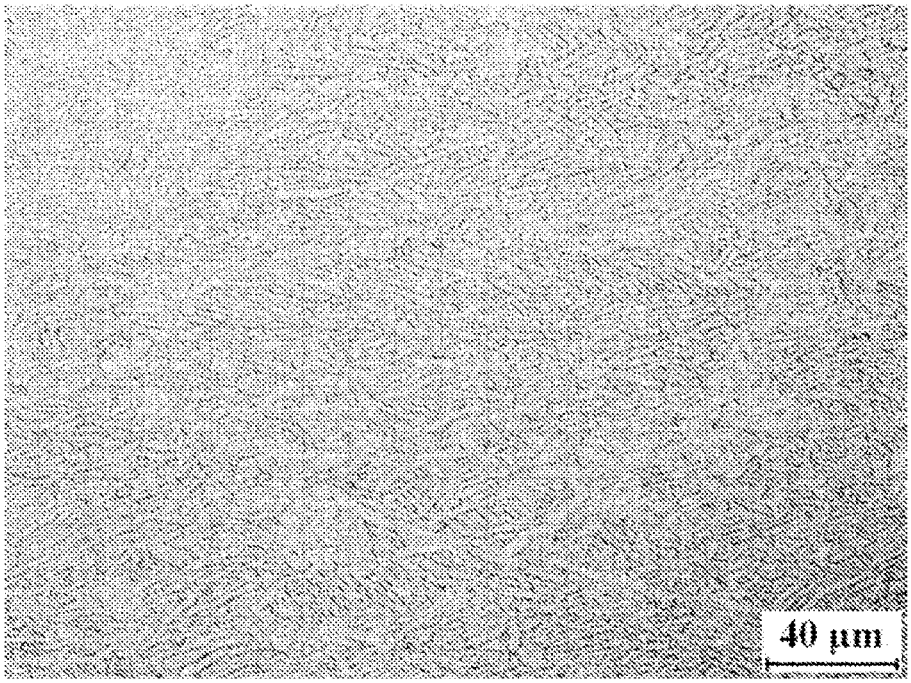
FIG. 8A is a picture showing an early structure of Ti-6Al-4Fe-0.25Si
Figure 8B:
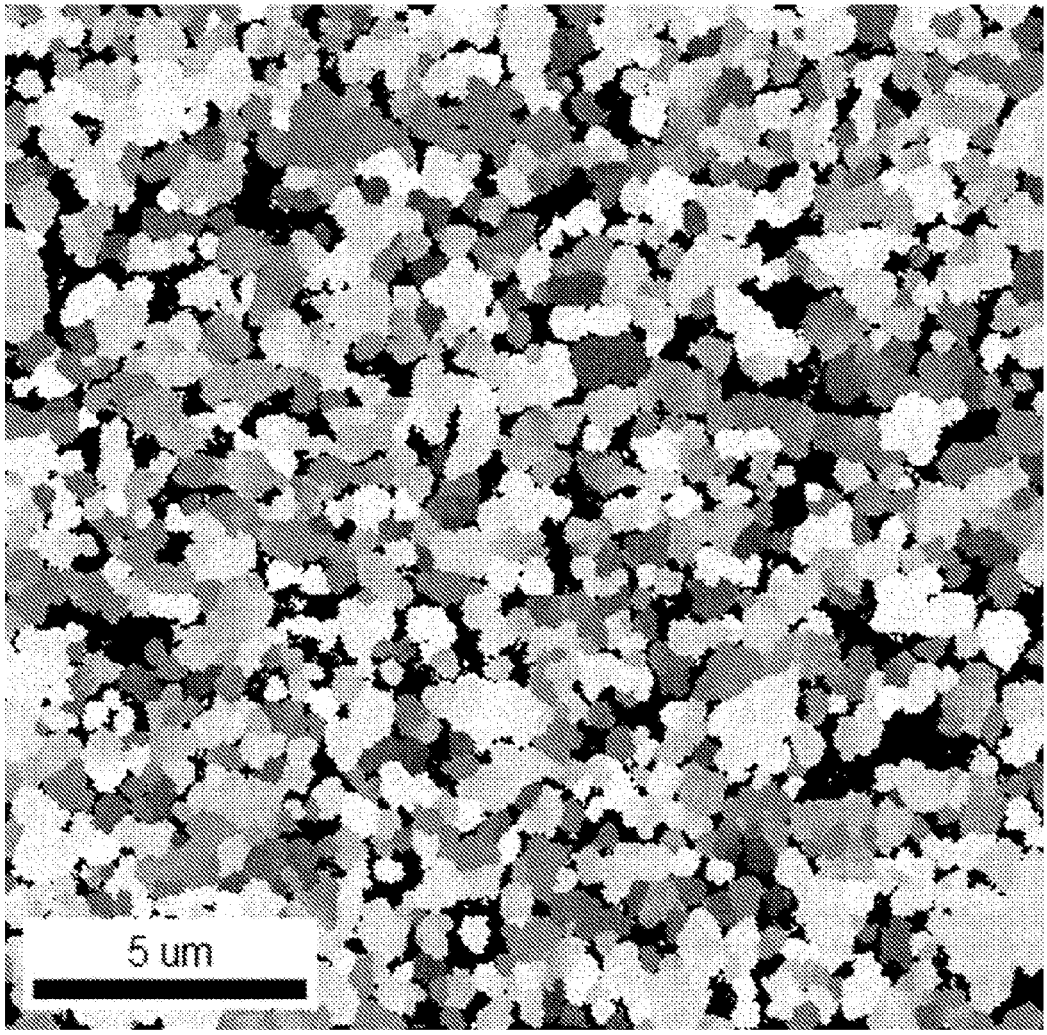
FIG. 8B is a picture of a microstructure of a titanium alloy (Ti-6Al-4Fe-0.25Si) manufactured by another embodiment of the present invention.

FIG. 8A is a picture showing an early structure of Ti-6Al-4Fe-0.25Si and FIG. 8B is a picture of a fine structure of a titanium alloy (Ti-6Al-4Fe-0.25Si) manufactured by another embodiment of the present invention.

FIG. 8A is a picture showing the state of grains of an early fine structure of a Ti-6Al-4Fe-0.25Si alloy, from which it can be seen that the sizes of the grains are not uniform.

On the contrary, FIG. 8B shows a fine picture of grains of a titanium alloy (Ti-6Al-4Fe-0.25Si) that has undergone the rolling of the method of manufacturing a titanium alloy (Ti-6Al-4Fe-0.25Si) according to another embodiment of the present invention.

In detail, it can be seen that the grains of the titanium alloy (Ti-6Al-4Fe-0.25Si) according to another embodiment of the present invention are ultrafine grains having a size of about 0.7 μm in FIG. 8B.

Forming of the ultrafine grains having a size of about 0.7 μm was generally possible only under the condition of a large strain of 4 to 8.

It can be seen that it is possible to manufacture a titanium alloy (Ti-6Al-4Fe-0.25Si) having ultrafine grains, as shown in FIG. 8B, under the condition of a strain of about 1.4, using the method of manufacturing a titanium alloy (Ti-6Al-4Fe-0.25Si) according to another embodiment of the present invention.

Figure 9:
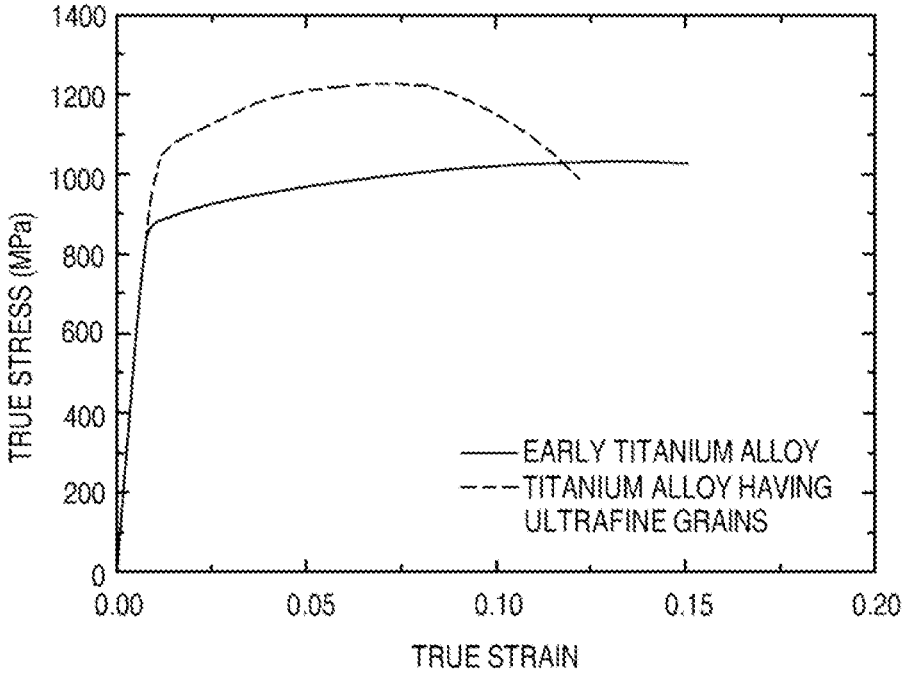
FIG. 9 is a graph showing a room-temperature tension property of a titanium alloy (Ti-6Al-4V) with high strength and high formability which is formed by an embodiment of the present invention.
Figure 10:
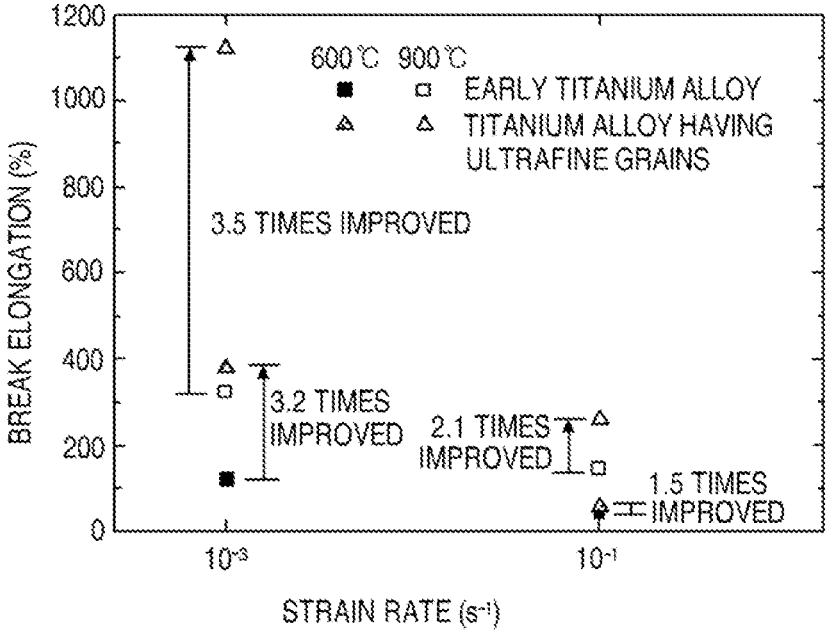
FIG. 10 is a graph showing a high-temperature tension property of a titanium alloy (Ti-6Al-4V) with high strength and high formability which is formed by an embodiment of the present invention.

FIG. 9 is a graph showing a room-temperature tension property of a titanium alloy (Ti-6Al-4V) with high strength and high formability which is formed by an embodiment of the present invention. FIG. 10 is a graph showing a high-temperature tension property of a titanium alloy (Ti-6Al-4V) with high strength and high formability which is formed by an embodiment of the present invention.

Referring to FIG. 9 first, comparing the room-temperature tension properties of a titanium alloy (Ti-6Al-4V) formed by the method of manufacturing a titanium alloy (Ti-6Al-4V) according to an embodiment of the present invention and an early titanium alloy, it can be seen that the yield strength and tensile strength of the titanium alloy (Ti-6Al-4V) formed by the manufacturing method according to an embodiment of the present invention were improved in comparison to the yield strength and tensile strength of the early titanium alloy.

Next, referring to FIG. 10, according to comparison under the condition of a strain rate of 0.001/sec and the condition of a temperature of 600° C., it can be seen that the break elongation of the titanium alloy (Ti-6Al-4V) according to an embodiment of the present invention was improved by 3.2 times of that of the early titanium alloy.

Further, according to comparison under the condition of a temperature 900° C., it can be also seen that the break elongation of the titanium alloy (Ti-6Al-4V) according to an embodiment of the present invention was 3.5 times that of the early titanium alloy and high-temperature formability was considerably improved.

Meanwhile, according to comparison under the condition of a strain rate of 0.11/sec, it can be seen that the break elongation was improved by 1.5 times under the condition of a temperature of 600° C. and 2.1 times under the condition of a temperature of 900° C.

As described above, it can be seen that it is possible to manufacture titanium alloys (Ti-6Al-4V and Ti-6Al-2Sn-2Mo-0.1Si) having ultrafine grains (1 μm or less) by using a small amount of energy consumption under a relatively low strain (strain of 2.5 or less) when using the method of manufacturing a titanium alloy according to an embodiment of the present invention, not a manufacturing method using general severe plastic deformation.

In detail, in general, since unstable deformation is generated at 750° C. or less, forming is performed between 800° C. and 950° C., and in the present invention, it was scientifically founded that formability increases because a lamellar structure is changed into an equiaxed structure with an increase in strain.

Therefore, it was possible to gradually decreasing the forming temperature to fit the condition where the strain increases. When it becomes possible to decrease the forming temperature, it is possible to reduce the amount of energy consumed in the rolling, so that it is possible to not only achieve an economic effect, but more easily perform the rolling for forming.

This is not conception that simply and freely decreases the forming temperature from 800° C. to 600° C., but conception that gradually changes the condition of the temperature in accordance the condition of the strain.

That is, the main conception of the present invention relates to a titanium alloy having ultrafine grains with high strength/high formability by making the final temperature, at which forming is finished, a plastic instability section or less of a lamellar structure (martensite) while gradually decreasing a forming temperature into an optimized condition, by using a principle that formability increases with an increase in a fine spheroidized structure during machining, after starting machining at the plastic instability section or more of an initial lamellar structure (martensite), not simply decreasing the forming temperature during forming, and a method of manufacturing the titanium alloy.

As it is possible to manufacture a titanium alloy having ultrafine grains under the condition of a low strain (strain of 2.5 or less), as described above, it is possible to produce titanium alloys having various sizes in large quantities at a low cost, using the infrastructures for rolling/extruding/forging which has been constructed and widely used in industry.

The titanium alloys (Ti-6Al-4V and Ti-6Al-2Sn-2Mo-0.1Si,Ti-6Al-4Fe-0.25Si) having ultrafine grains which are manufactured, as described above, can also be provided with high strength/high formability in comparison to the existing titanium alloys.

The spirit of the present invention may be applied to titanium alloys having different compositions other than the compositions of the titanium alloys described herein.

According to a method of manufacturing titanium alloys (Ti-6Al-4V,Ti-6Al-2Sn-2Mo-0.1Si, and Ti-6Al-4Fe-0.25Si) with high strength and high formability, it can be seen that it is possible to manufacture titanium alloys (Ti-6Al-4V,Ti-6Al-2Sn-2Mo-0.1Si, and Ti-6Al-4Fe-0.25Si) having ultrafine grains (1 μm or less) by using a small amount of energy consumption under a low strain (strain of 2.5 or less) when using the method of manufacturing a titanium alloy according to an embodiment of the present invention, not a manufacturing method using general severe plastic deformation.

As it is possible to manufacture a titanium alloy having ultrafine grains under the condition of a low strain (strain of 2.5 or less), as described above, it is possible to produce titanium alloys having various sizes in large quantities at a low cost, using the infrastructures for rolling/extruding/forging which has been constructed and widely used in industry.

The titanium alloys (Ti-6Al-4V, Ti-6Al-2Sn-2Mo-0.1Si, and Ti-6Al-4Fe-0.25Si) having ultrafine grains which are manufactured, as described above, can also be provided with high strength/high formability in comparison to the existing titanium alloys.

While the present invention has been described with respect to the specific embodiments, it will be apparent to those skilled in the art that various changes and modifications may be made without departing from the spirit and scope of the invention as defined in the following claims.

What is claimed is:

1. A method of manufacturing a titanium alloy, the method comprising:

preparing a titanium alloy material and equipment for manufacturing a titanium alloy;

manufacturing the titanium alloy having a lamellar structure by cooling the prepared titanium alloy material with water after performing heat treatment at the beta transformation temperature or more; and rolling that makes ultrafine grains by finishing forming of the titanium alloy at a plastic instability temperature by gradually decreasing the forming temperature in accordance with an increase of a strain after starting the forming at the plastic instability temperature or more, under a condition of a low strain in which the strain is 2.5 or less, after the manufacturing of a titanium alloy having a lamellar structure.

2. The method of claim 1, wherein, in the rolling, the initial forming start temperature for starting the forming is the plastic instability temperature or more of an initial lamellar structure, the final forming temperature for finishing the forming is the plastic instability temperature or less of an initial lamellar structure, and the process is finished while maintaining the plastic instability temperature or less of the initial lamellar structure when the strain reaches 2.5 while decreasing the temperature along a predetermined drop curve in accordance with an increase in the strain after starting the forming at a forming temperature of the plastic instability temperature or more at the initial stage.

* * * * *